US007108448B2

(12) United States Patent
Hagenah

(10) Patent No.: US 7,108,448 B2
(45) Date of Patent: Sep. 19, 2006

(54) PAVING STONE KIT

(75) Inventor: Gerhard Hagenah, Worpswede (DE)

(73) Assignee: SF-Kooperation GmbH Beton-Konzepte, (DE)

( * ) Notice: Subject to any disclaimer, the term of this patent is extended or adjusted under 35 U.S.C. 154(b) by 70 days.

(21) Appl. No.: 10/503,197

(22) PCT Filed: Jan. 11, 2003

(86) PCT No.: PCT/EP03/00206

§ 371 (c)(1),
(2), (4) Date: Jan. 18, 2005

(87) PCT Pub. No.: WO03/066965

PCT Pub. Date: Aug. 14, 2003

(65) Prior Publication Data

US 2005/0129462 A1 Jun. 16, 2005

(30) Foreign Application Priority Data

Feb. 7, 2002 (DE) ..... 102 05 160

(51) Int. Cl.
*E01C 5/00* (2006.01)

(52) U.S. Cl. ..... 404/41; 404/42

(58) Field of Classification Search ..... 404/17, 404/18, 34–46; 52/596, 604, 608
See application file for complete search history.

(56) References Cited

U.S. PATENT DOCUMENTS

| | | | | | |
|---|---|---|---|---|---|
| 2,340,526 | A * | 2/1944 | Green | 404/42 |
| 3,870,423 | A * | 3/1975 | Peitz, Jr. | 404/41 |
| 3,923,410 | A * | 12/1975 | Jordan et al. | 404/41 |
| 4,496,266 | A * | 1/1985 | Ruckstuhl | 404/41 |
| 5,028,167 | A * | 7/1991 | Scheiwiller | 404/41 |
| 5,173,003 | A * | 12/1992 | Hair | 404/41 |
| 5,249,884 | A * | 10/1993 | Widmer | 404/42 |
| 5,275,503 | A * | 1/1994 | Lewis et al. | 404/42 |
| D346,037 | S * | 4/1994 | Ingvorsen | D25/151 |
| 5,428,934 | A * | 7/1995 | Tomek | 52/608 |
| 5,560,173 | A * | 10/1996 | Scheiwiller | 52/608 |
| 5,884,445 | A * | 3/1999 | Woolford | 52/311.2 |
| 6,269,605 | B1 * | 8/2001 | Geiger | 52/608 |
| 2001/0048849 | A1 * | 12/2001 | Rinninger | 404/41 |

FOREIGN PATENT DOCUMENTS

| | | |
|---|---|---|
| DE | 1969156 U | 9/1967 |
| DE | 2452475 A1 | 5/1976 |
| DE | 2630289 A1 | 1/1978 |
| DE | 2836980 A1 | 3/1980 |

(Continued)

OTHER PUBLICATIONS

"Deutsches Patent-und Markenamt" (German language version of the patent examinatino report from the German Patent Office on the priority application) Sep. 24, 2002.

*Primary Examiner*—Thomas B. Will
*Assistant Examiner*—Alexandra Pechhold
(74) *Attorney, Agent, or Firm*—Powell Goldstein LLP; Laurence P. Colton

(57) ABSTRACT

A block pavement comprising (concrete) paving blocks (11, 12) is formed in such a way that individual paving strips (21, 22) adjoining one another are delimited from one another by strip joints (23, 24) designed in a wave-like manner. Each paving strip (21, 22) comprises a block unit (10), which is formed along the lines of the contour of a paving strip (21, 22).

11 Claims, 2 Drawing Sheets

FOREIGN PATENT DOCUMENTS

| | | | | |
|---|---|---|---|---|
| DE | 9218311 | U1 | | 2/1994 |
| DE | 4317442 | A1 | | 12/1994 |
| DE | 19850774 | A1 | | 5/2000 |
| DE | 19910864 | A1 | | 9/2000 |
| EP | 91107 | A1 | * | 10/1983 |
| FR | 2551783 | A | | 3/1983 |
| FR | 2585386 | A1 | * | 1/1987 |

* cited by examiner

Fig. 2
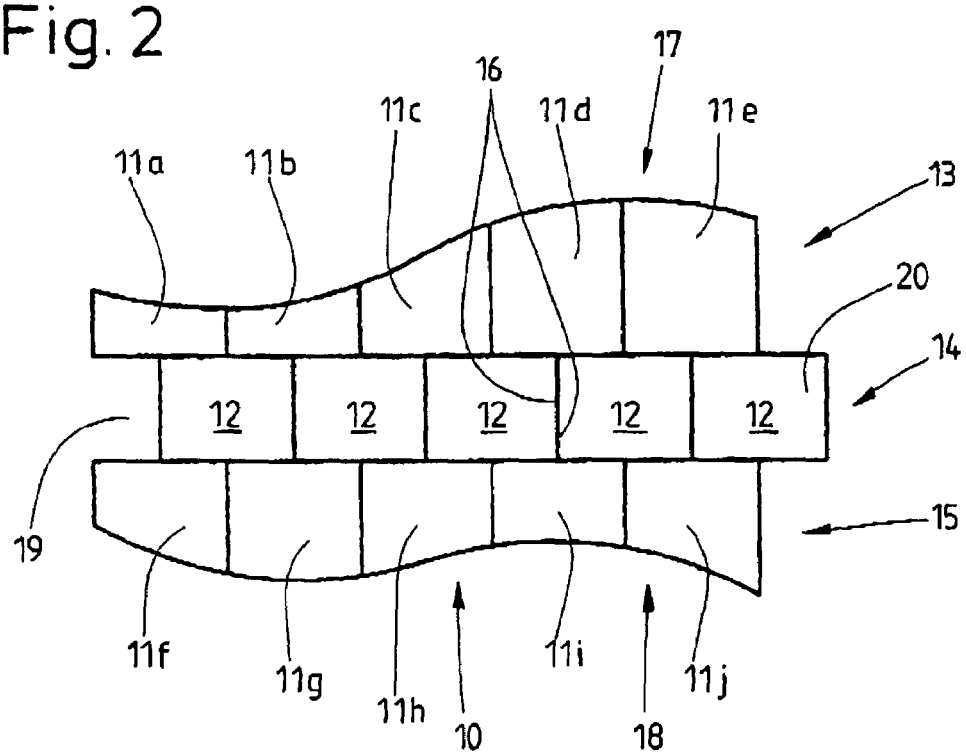
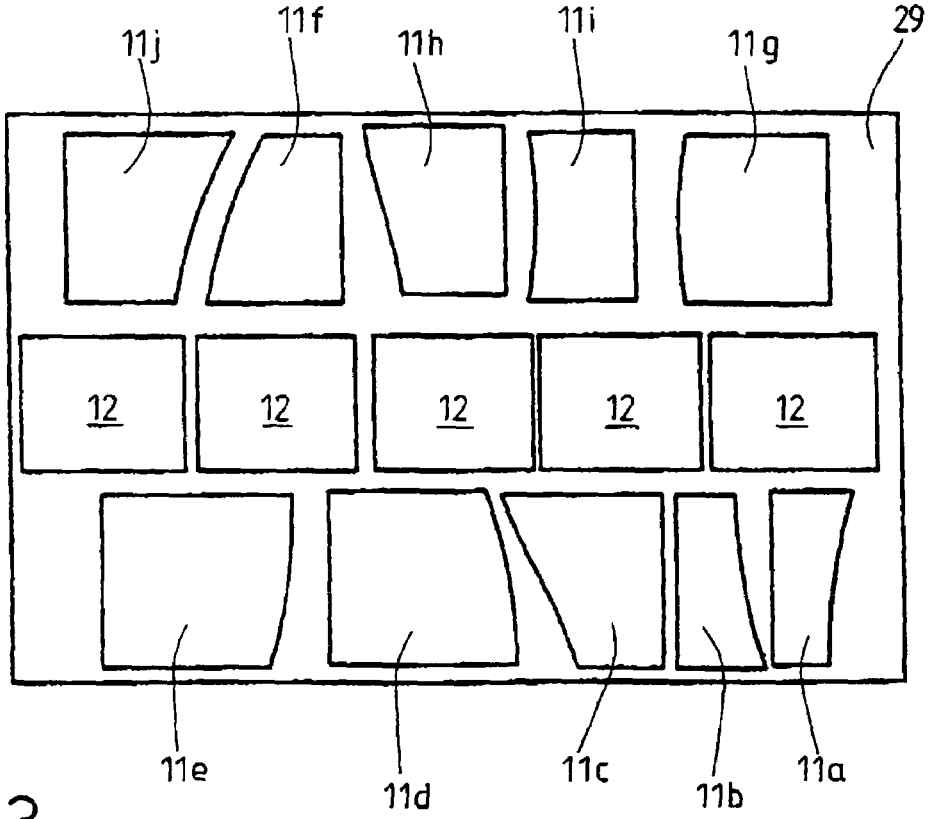
Fig. 3

PAVING STONE KIT

STATEMENT OF RELATED APPLICATIONS

This patent application is the United States of America Patent Cooperation Treaty (PCT) Chapter II National Phase application of PCT International Application No. PCT/EP03/00206 having an International Filing Date of 11 Jan. 2003 and which designates the United States of America, which claims priority on German patent application 102 05 160.7 having a filing date of 7 Feb. 2002.

BACKGROUND OF THE INVENTION

1. Technical Field

The invention relates to a set of (concrete) paving blocks for producing coverings over the ground, a number of matching paving blocks respectively forming a block unit and a number of block units forming the covering over the ground.

2. Prior Art

When designing block pavements, in particular in inner-city areas, a special, decorative design is increasingly being demanded. This requirement is met by the industry in some cases by complicated design of the individual paving blocks, involving relatively high production costs for the paving blocks.

BRIEF SUMMARY OF THE INVENTION

The invention is based on the object of proposing a set of concrete paving blocks which is produced industrially and consequently at low cost, but at the same time makes it possible for the block pavements to have special design features.

To achieve this object, the set according to the invention is characterized by the following features:

a) a block unit comprises at least two rows of blocks comprising paving blocks lying next to one another,
b) the paving blocks have on outer sides of the rows of blocks that are remote from one another—longitudinal sides—a contour other than a continuous straight contour,
c) the contours of the two longitudinal sides are made to match each other with regard to shape and size in such a way that the block units can be laid against one another with interlocking contact.

Particularly advantageous is a configuration of the paving blocks or rows of blocks in which the outer contour, that is the two longitudinal sides, of a block unit are formed in a correspondingly wave-like manner in such a way that a paving strip formed by block units laid next to one another is formed in a wave-like manner on transversely directed edge surfaces.

The number of paving blocks per block unit is chosen such that on the one hand complete units which can be installed with one another are obtained, on the other hand a block unit can be produced in its complete form in one working cycle of a block forming machine. Furthermore, a block unit may be formed in such a way that at the same time it forms a laying unit, that is a group of paving blocks arranged in the formation of the block pavement which can be laid as a unit by a suitable laying machine.

Particularly advantageous are block units respectively comprising three rows of blocks, of which the two rows of blocks at the edges have a shaped, contoured outer side, while the middle row of blocks comprises rectangular or square, in any event geometrically regular, paving blocks.

Furthermore, it is also of significance that the paving blocks of the middle row of blocks are offset in relation to the uniformly positioned paving blocks of the outer rows of blocks.

BRIEF DESCRIPTION OF THE DRAWINGS

Further features and special aspects of the invention are explained in more detail below on the basis of the drawings of the patent, in which:

FIG. 2 shows a block unit in a position in which it can be laid.

FIG. 3 shows the positioning of the individual paving blocks of a complete block unit on an underlying support of a concrete block making machine.

DETAILED DESCRIPTION OF THE PREFERRED EMBODIMENTS

Figure 1:
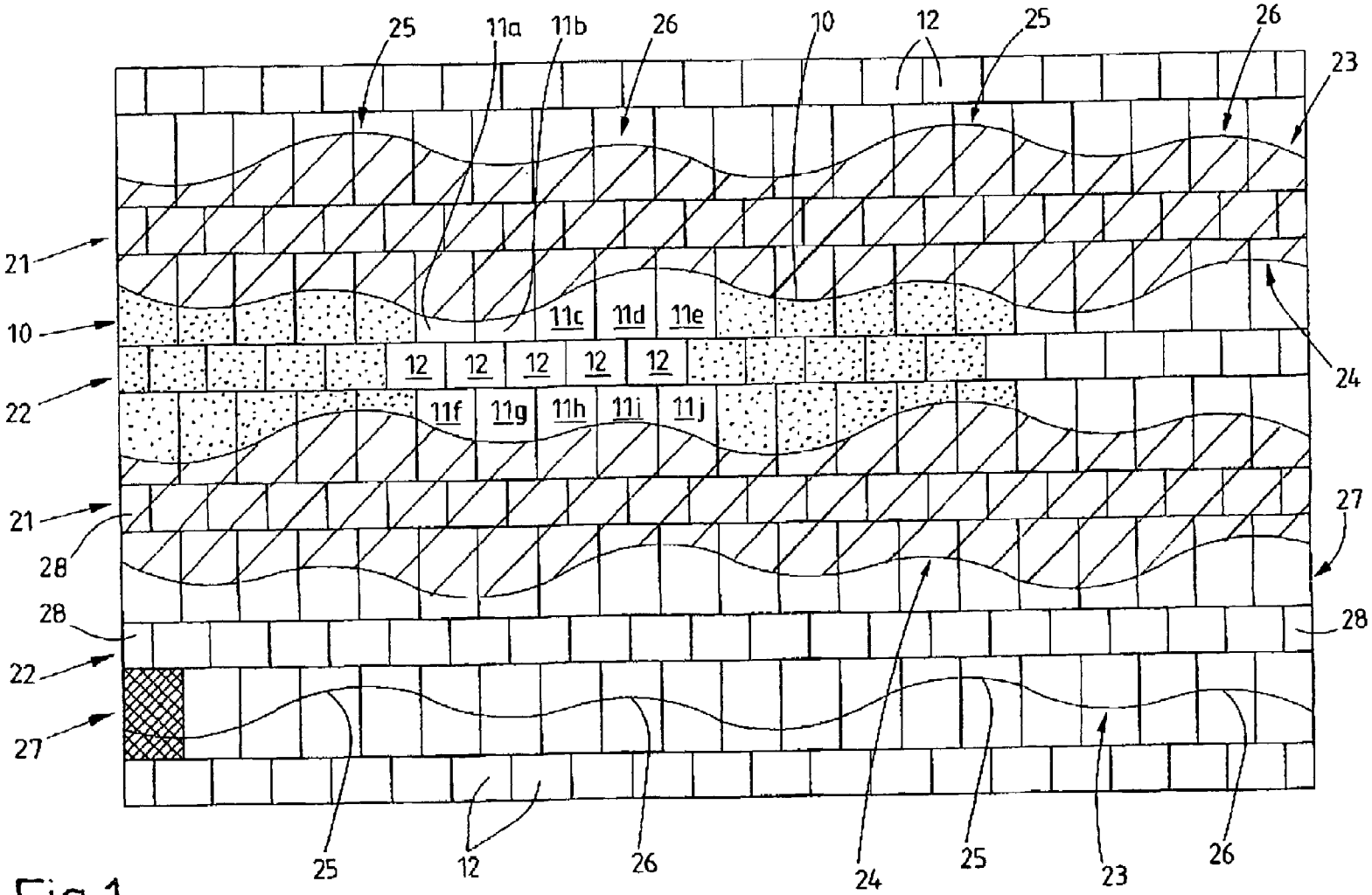
FIG. 1 shows a block pavement comprising a number of wave-like paving strips adjoining one another.

The drawings are concerned with the configuration of the individual paving blocks, block units formed from them and the ground covering or block pavement formed from a plurality of block units.

In FIG. 1, a detail of a block pavement, for example of a plaza, is shown in plan view. The block pavement is decoratively designed on the basis of specific geometrical shapes of the paving blocks and the special way in which they are laid. For this purpose, the block pavement is made up of a plurality of block units 10. The block unit (FIG. 2) comprises a plurality of different (concrete) paving blocks 11 and 12. To form the block unit 10, these are positioned as a formation comprising a number of rows of blocks 13, 14, 15, in the example of FIG. 2 that is with three rows of blocks 13, 14, 15 and five paving blocks 11, 12 per row of blocks 13, 14, 15. The middle row of blocks 14 comprises regularly shaped paving blocks 12, that is to say with a shape that is rectangular in outline, cuboidal overall. The paving blocks 12 are laid in a row, with joints being formed, smaller side faces 16 butting against one another within the row of blocks 14.

The paving blocks 11 of the two outer rows of blocks 13 and 15 are specially designed, to be precise in such a way that all the paving blocks 11*a*, 11*b*, 11*c*, 11*d*, 11*e*, 11*f*, 11*g*, 11*h*, 11*i*, 11*j* are differently formed. The paving blocks 11, made to match one another with regard to their shape, define within the row 13, 15 a contoured outer side or longitudinal side 17, 18. In the case of the present exemplary embodiment, the two longitudinal sides 17, 18 of the block unit 10 are designed in a wave-like manner, to be precise in different, matching ways.

The paving blocks 11 of the two outer rows of blocks 13, 15 are aligned with one another within the block unit 10, so that joints formed between the paving blocks 11*a*, 11*b* . . . of the two rows of blocks 13, 15 are correspondingly aligned with one another. The paving blocks 12 of the middle row of blocks 14 are arranged offset in relation thereto, so that continuous transverse joints are avoided. Each block unit 10 consequently forms at the end of the row of blocks 14 on one side a depression 19 and on the other side a projection 20, in each case of the size of half a paving block 12.

When forming the block pavement (FIG. 1), the block units 10 formed in this way are set in rows next to one another in such a way that the paving blocks 12 of the middle row of blocks 14 form a continuous, aligned row of blocks. On account of the contours of the longitudinal sides 17 and 18, paving strips 21, 22 with edges shaped in a wave-like manner on the basis of the continuous longitudinal sides 17, 18 are produced within the block pavement. In FIG. 1, individual paving strips 21 are marked as shaded areas for identification. The entire block pavement is formed from a plurality of paving strips 21, 22 adjoining one another, it being possible in practice for the paving strips 21, 22 to be accentuated by designing the paving blocks differently, in particular by different coloring.

The paving strips 21, 22 comprise block units 10 which coincide with one another with regard to the shape of the paving blocks. In a paving strip 21, 22, successively following block units 10 are merely laid the other way round, so that one longitudinal side 17 is adjoined by a longitudinal side 18 of a neighboring block unit 10 in such a way that it fits. In FIG. 1, block units 10 within one paving strip 22 are identified by graphic marking.

The paving strips 21, 22 are delimited on both sides by wave-like, continuous strip joints 23, 24. These geometrically form a wavy line of an irregular profile, that is to say more pronounced waves 25 and less pronounced waves 26, which alternate with one another. The wave formation of the two strip joints 23, 24 delimiting the paving strips 21, 22 are offset with respect to one another. Accordingly, a larger wave 25 of the strip joint 23 is opposed by a smaller wave 26 of the strip joint 24. Alternatively, the strip joints 23, 24 may also be formed as a regular wave.

The paving blocks 11 are made to match one another with regard to shape and size on the basis of geometrical laws. In the case of the exemplary embodiment shown, the concept of the design was based on a double block 27. This has a dimension in the direction transverse to the rows of blocks 13, 14, 15 which corresponds to twice the width of the paving block 12, but may also have a different dimension. Placed into this (imaginary) double block 27, which is identified in FIG. 1 by cross-shading, or into a continuous row of double blocks 27 lying against one another, is the strip joint 23, 24 as a geometrical separating line, dividing the double blocks 27 into the paving strips 11*a*, 11*b* . . . . It follows from this that in each case two of the paving blocks 11*a*, 11 *b* . . . that are contoured on one side are assigned to one another and together form an (imaginary) double block 27. Accordingly, any suitable geometrical separating line may be placed as a strip joint 23, 24 within a row of double blocks 27, with correspondingly different, matching paving blocks 11.

A further special feature is that no special edge or corner blocks are required for a block pavement formed in this way. Depressions 19 produced on longitudinal edges of the block pavement are filled by half-blocks 28. These are produced by dividing a paving block 12 down the middle directly at the laying site. For this purpose, on the respectively opposite side an overhanging paving block 12 is cut through, creating a straight edge contour of the block pavement. The end of a block pavement is formed by a terminating row of paving blocks 12, as shown in FIG. 1.

The number and size of the paving blocks 11, 12 per block unit 10 is expediently chosen such that a complete block unit 11 can be produced in one operation by a block forming machine. This machine is equipped in the usual way with a mold frame, which has mold cavities for one paving block 11, 12 each. The mold frame rests on an underlying support—pallet 29. The finished, raw paving blocks 11, 12 are introduced into a curing device, while lying on the pallet 29, once the mold frame has been lifted off. FIG. 3 shows how the paving blocks 11 and 12 can be spatially positioned on the pallet 29 in a favorable way, corresponding to the production cycle of the block forming machine.

The geometrical shape of the longitudinal sides 17 and 18, and consequently of the strip joints 23, 24, may have a different form, for example a zigzag-shaped form, taking into consideration the interrelated aspects described. It is also conceivable to provide a number of intermediate rows corresponding to the block row 14. With regard to the configuration of a covering over the ground, a single paving strip 21, 22 is suitable as a paved, contoured path in gardens and parks.

LIST OF DESIGNATIONS 10 block unit
11 paving block
12 paving block
13 row of blocks
14 row of blocks
15 row of blocks
16 side face
17 longitudinal side
18 longitudinal side
19 depression
20 projection
21 paving strip
22 paving strip
23 strip joint
24 strip joint
25 wave
26 wave
27 double block
28 half-blocks
29 pallet

The invention claimed is:

1. A set of paving blocks (11, 12) for producing a covering over the ground, in each case a number of matching paving blocks (11, 12) forming a block unit (10) and a number of said block units (10) forming said covering over the ground, comprising:

a) each of said block unit (10) comprises at least two rows of said blocks (13, 14, 15) lying next to one another, wherein within each of said block unit (10) all of said blocks (11, 12) are arranged in such a way that joints are formed between abutting blocks (11, 21);

b) said paving blocks (11, 12) of said block unit (10) have on outer longitudinal sides (17, 18) of the rows of said blocks (13, 15) that are remote from one another a wave-like contour in the shape of a continuous curve;

c) the contours of the two outer longitudinal sides (17, 18), are made to match each other with regard to shape and size in such a way that the block units (10) are laid against one another with interlocking contact; and d) a middle row (14) of said rows of said blocks of said block unit (10) comprises regular paving blocks (12) that are rectangular or square in outline.

2. The set as claimed in claim 1, characterized in that the outer sides, namely longitudinal sides (17, 18), of a block unit (10) are formed in said wave-like manner in such a way that a paving strip (21, 22) formed by block units lying next to one another is formed in said wave-like manner on transversely directed edge surfaces, namely strip joints (23, 24).

3. The set as claimed in claim 1, characterized in that the rows of blocks (13, 15) that are contoured in said wave-like manner on the longitudinal sides (17, 18) lie against one another or against one or more middle rows of blocks (14) along a straight, continuous joint, namely a row joint.

4. The set as claimed in claim 1, characterized in that a block unit (10) comprises three rows of blocks (13, 14, 15).

5. The set as claimed in claim 3, characterized in that the middle row of blocks (14) comprises rectangular or square paving blocks (12) arranged offset in relation to the paving blocks (11) of the neighboring, outer rows of blocks (13, 15) in such a way that two straight row joints are formed on either side of the middle row of blocks (14).

6. The set as claimed in claim 1, characterized in that each row of blocks (13, 14, 15) of a block unit (10) comprises five paving blocks (11, 12), the paving blocks (11, 12) having a uniform width as seen in the longitudinal direction of the row joints.

7. The set as claimed in claim 2, characterized in that the block units (10) are arranged offset in such a way from paving strip (21) to paving strip (22) that, on either side of contours, namely strip joints (23, 24), the paving strips (21, 22) are delimited with an uneven profile of the waves.

8. The set as claimed in claim 2, characterized in that the block units (10) lying next to one another within paving strip (21, 22) are interlocked, in particular by depressions (19) and projections (20) in the region of middle rows of blocks (14) that are arranged offset.

9. The set as claimed in claim 1, characterized in that a block unit (10) corresponds with regard to the number of paving blocks (11, 12) to the capacity of a concrete block mold, of a concrete block making machine, in such a way that a complete block unit can be produced on an underlying support or a pallet (29) in one production cycle.

10. The set as claimed in claim 2, characterized in that the rows of blocks (13, 15) that are contoured in said wave-like manner on the longitudinal sides (17, 18) lie against one another or against one or more middle rows of blocks (14) along a straight, continuous joint, namely a row joint.

11. The set as claimed in claim 10, characterized in that the middle row of blocks (14) comprises rectangular or square paving blocks (12) arranged offset in relation to the paving blocks (11) of the neighboring, outer rows of blocks (13, 15) in such a way that two straight row joints are formed on either side of the middle row of blocks (14).

* * * * *